US007867029B2

(12) United States Patent
Takahashi et al.

(10) Patent No.: US 7,867,029 B2
(45) Date of Patent: Jan. 11, 2011

(54) CONNECTOR HOUSING AND CONNECTOR

(75) Inventors: Toshiharu Takahashi, Makinohara (JP); Motoyoshi Suzuki, Makinohara (JP)

(73) Assignee: Yazaki Corporation (JP)

( * ) Notice: Subject to any disclaimer, the term of this patent is extended or adjusted under 35 U.S.C. 154(b) by 0 days.

(21) Appl. No.: 12/547,807

(22) Filed: Aug. 26, 2009

(65) Prior Publication Data

US 2010/0055955 A1 Mar. 4, 2010

(30) Foreign Application Priority Data

Aug. 27, 2008 (JP) ..... 2008-218282

(51) Int. Cl.
*H01R 13/40* (2006.01)

(52) U.S. Cl. ..... 439/595

(58) Field of Classification Search ..... 439/595
See application file for complete search history.

(56) References Cited

U.S. PATENT DOCUMENTS 6,626,701 B2 * 9/2003 Yoshida et al. ..... 439/595

FOREIGN PATENT DOCUMENTS

JP 50-113881 U 9/1975

* cited by examiner

*Primary Examiner*—Truc T Nguyen
(74) *Attorney, Agent, or Firm*—Sughrue Mion, PLLC

(57) ABSTRACT

This invention provides with a connector housing in which a retaining arm for fixing a metal terminal to be inserted into a receiving chamber is formed within the receiving chamber, and extends in a direction of insertion of the metal terminal, and the retaining arm has a convex retaining portion to be engaged with a predetermined retaining hole formed in the metal terminal, wherein the retaining portion has a first slanting surface formed at a central portion of the retaining portion in a direction perpendicular to the direction of insertion of the metal terminal, and a pair of second slanting surfaces formed respectively at opposite side portions to the central portion, the second slanting surfaces being gentler in inclination angle than the first slanting surface; and at an arbitrary position in the direction of extending of the retaining arm in a range in which the first slanting surface is disposed above a predetermined height, the second slanting surfaces are disposed lower than the first slanting surface.

6 Claims, 6 Drawing Sheets

CONNECTOR HOUSING AND CONNECTOR

BACKGROUND OF THE INVENTION

1. Field of the Invention

This invention relates to a connector housing and a connector, and more particularly to a connector housing and a connector, in which a metal terminal is retained by a retaining arm (lance) formed within the connector housing.

2. Description of the Related Art

There has heretofore been used a technique in which a male connector and a female connector, each having metal terminals beforehand received in its connector housing, are fitted together, thereby connecting the metal terminals of the male connector respectively to the metal terminals of the female connector. For example, as disclosed in Patent Literature 1, cantilever-like retaining arms (called "lances") for retaining the metal terminals respectively at predetermined positions within the connector housing are formed within the connector housing, and each metal terminal is retained by a convex lance beak formed at a free or distal end portion of the retaining arm.

FIG. 1 is a cross-sectional view of a conventional connector housing 110 analogous to the connector housing disclosed in the above Patent Literature 1. FIG. 2 is a perspective view roughly showing the construction of a female metal terminal 80 to be received in the connector housing 110. Although the front, rear, right and left sides are set as shown in the drawings for description purposes, this may actually be changed. This can be applied also to FIG. 4 referred to later. A pair of upper and lower receiving chambers 120 for receiving the metal terminals 80 are formed within the connector housing 110. A male terminal insertion hole 124 is formed at the front side of each receiving chamber 120. Here, description will be made of the case of inserting the metal terminal 80 into the upper receiving chamber 120. A lance 150 is formed on and extends forwardly (left in the drawings) from a generally central portion of a receiving chamber partition portion 130 separating the pair of upper and lower receiving chambers 120 from each other. A rear half portion of the receiving chamber partition portion 130 disposed at the rear side of the lances 150 is thick, while a front half portion thereof is made thin to provide spaces (designated by reference numeral 121 only in FIG. 1A) each for allowing the lance 150 to be elastically bent in the upward-downward direction. The metal terminal 80 includes a barrel portion 81 having a cable W fixedly connected thereto by crimping or press-clamping, and a connection portion body 90. The connection portion body 90 has a generally box-shape, and a male terminal (not shown) can be inserted into the connection portion body 90 through a front open end thereof. A guide groove 95 is formed a lower wall 98 (FIG. 1A) of the connection portion body 90, and extends in the forward-rearward direction as shown in FIG. 2. A beak retaining hole 94 is formed at a generally central portion of the guide groove 95, and a lance beak 54 (described later) is adapted to be retainingly engaged in this beak retaining hole 94.

FIGS. 3A to 3D show the lance 150. FIG. 3A is a perspective view of the lance 150, FIG. 3B is a perspective view schematically showing the lance 150, FIG. 3C is an enlarged view of a region Y1 of FIG. 1A, and more specifically is a side-elevational view of the lance 150, and FIG. 3D is an enlarged view of a region Y2 of FIG. 1B, and more specifically is a side-elevational view of the lance 150, showing a condition in which the metal terminal 80 abuts against the lance beak 153. The lance 150 can be elastically deformed in the upward-downward direction so as to effectively achieve the insertion and fixing of the metal terminal 80. More specifically, the lance beak 153 having a trapezoidal vertical cross-section is formed on a front end portion of a lance base 151 of a generally rectangular parallelepiped shape extending from the thickened portion of the receiving chamber partition portion 130. Further, the lance 150 has a front free end 152 formed at the front side of the lance beak 153. The lance beak 153 disposed in the upper receiving chamber 120 is upwardly convex, while the lance beak 153 disposed in the lower receiving chamber 120 is downwardly convex. The lance 150 has a lance guide 154 of a predetermined height and a predetermined width extending from its proximal end portion to the lance beak 153.

The metal terminal 80 is inserted into the receiving chamber 120 from the rear side of the connector housing 110, and is moved forward with the lance guide 154 fitted in the guide groove 95 of the connection portion body 90. Then, a front end 91 of the metal terminal 80 is brought into abutting engagement with the lance beak 153 as shown in FIGS. 1B and 3D, and then the metal terminal 80, while elastically bending the lance 150 downwardly, further moves to an inner end portion of the receiving chamber 120 as shown in FIG. 1C, so that the lance beak 153 is retainingly engaged in the beak retaining hole 94 formed in the connection portion body 90, thereby fixing the metal terminal 80 to the connector housing 110.

Patent Literature 1: JP-UM-A-50-113881

With respect to the shape of the lance 150, in the case where the angle of inclination of a slanting surface 161 of the lance beak 153 is large, the front end 91 of the inserted metal terminal 80, when abutting against the lance beak 153, is sometimes caught by this lance beak 153 at an abutting point P1 (see FIG. 3D), so that the metal terminal 80 can not advance any further, thus inviting a condition of so-called striking abutment. At this time, a load several times larger than the force of insertion of the metal terminal 80 acts on the lance beak 153, and the operation for inserting the metal terminal 80 has sometimes been retarded. Usually, about one second is required form inserting the metal terminal 80, but when the striking abutment occurs, about 10 seconds have often been required, thus much lowering the efficiency of the operation. In some cases, the metal terminal 80 fails to be completely inserted, or the lance 150 is shaved by the metal terminal 80, so that incomplete electrical connection may be caused by resulting shavings. Therefore, it has been desired to provide a technique for improving these points.

SUMMARY OF THE INVENTION

This invention has been made in view of the above circumstances, and an object of the invention is to provide a technique by which the occurrence of striking abutment is reduced when inserting a metal terminal into a connector housing.

This invention provides a connector housing in which a retaining arm for fixing a metal terminal to be inserted into a receiving chamber is formed within the receiving chamber, and extends in a direction of insertion of the metal terminal, and the retaining arm has a convex retaining portion to be engaged with a predetermined retaining hole formed in the metal terminal; wherein the retaining portion has a first slanting surface formed at a central portion of the retaining portion in a direction perpendicular to the direction of insertion of the metal terminal, and a pair of second slanting surfaces formed respectively at opposite side portions to the central portion, the second slanting surfaces being gentler in inclination angle than the first slanting surface; and at an arbitrary position in the direction of extending of the retaining arm in a range in which the first slanting surface is disposed above a predetermined height, the second slanting surfaces are disposed lower than the first slanting surface.

In the present invention, when inserting the metal terminal into the connector housing, the occurrence of striking abutment of the metal terminal with the retaining arm (lance) can be reduced.

DESCRIPTION OF THE PREFERRED EMBODIMENTS

A preferred embodiment of the present invention will now be described with reference to the drawings. When inserting a metal terminal into a connector housing, a distal end portion of the metal terminal is sometimes brought into striking abutment with a lance beak as described above. The angle of that portion of the lance beak for contact with the metal terminal (that is, the angle of inclination of the lance beak) can not be made so gentle in view of the need for retaining engagement of the lance beak with a beak retaining hole. Therefore, in this embodiment, slanting surfaces having a gentler angle are formed respectively at opposite side portions of the lance beak, thereby reducing the above striking abutment, while the angle of inclination of that portion of the lance beak for retaining engagement with the beak retaining hole of the metal terminal is sufficiently large as in the conventional construction.

Figure 1A:
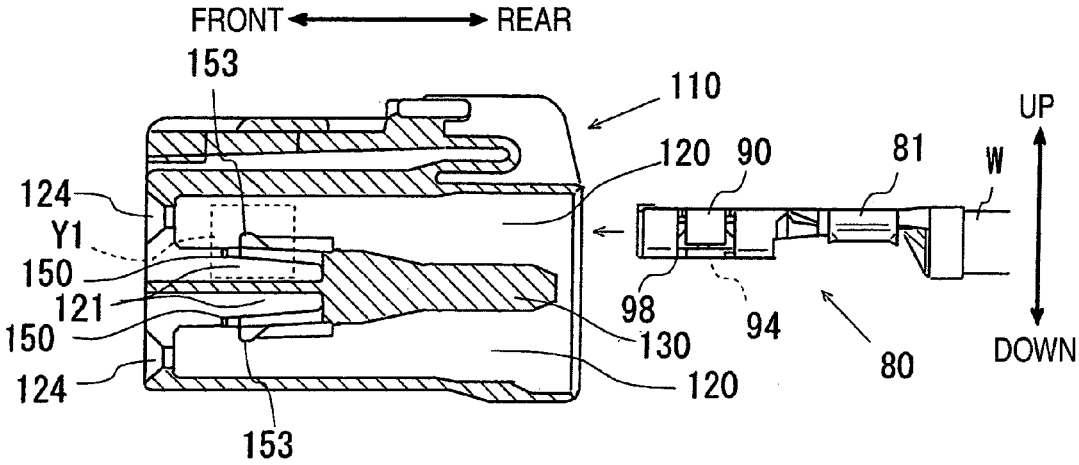
FIGS. 1A to 1C are a cross-sectional view of a conventional connector housing.
Figure 1B:
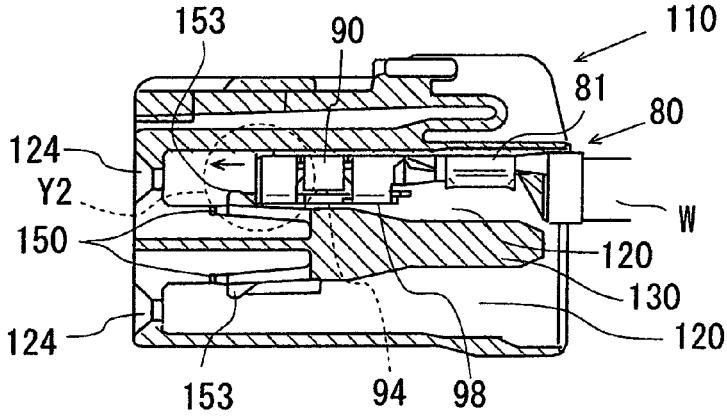
Figure 1C:
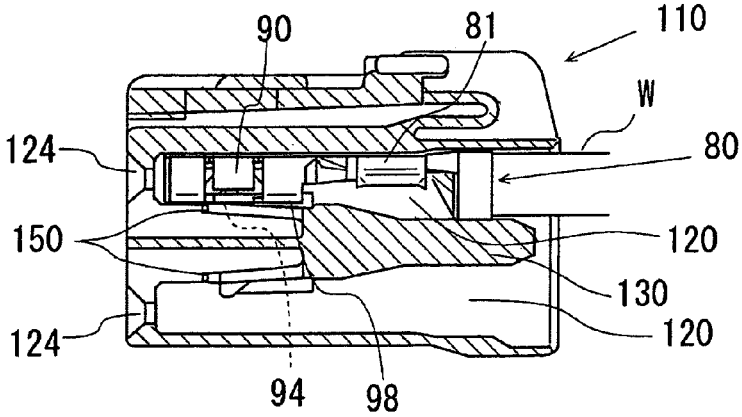
Figure 2:
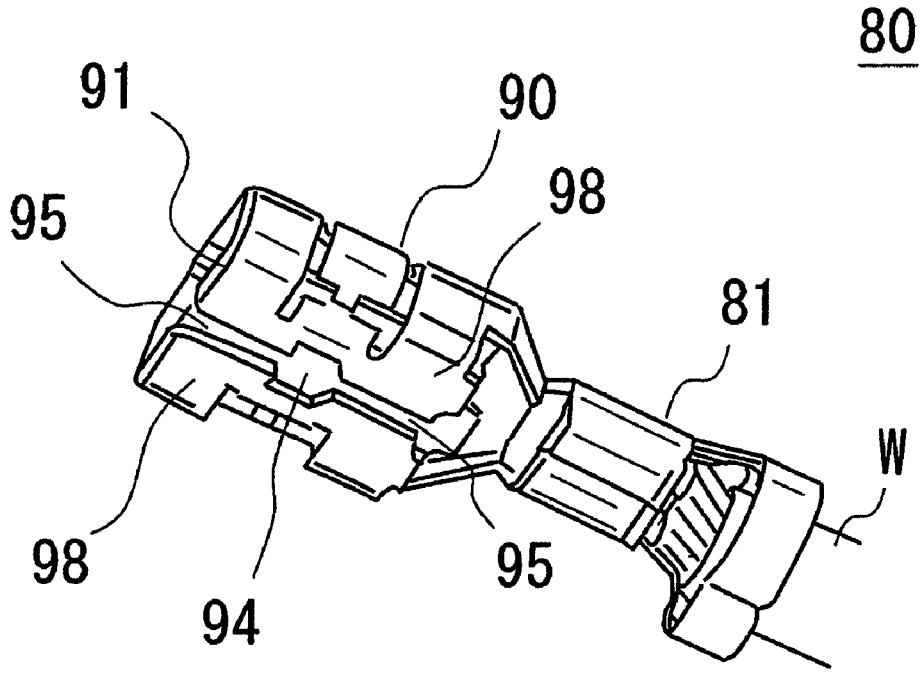
FIG. 2 is a perspective view of a metal terminal to be received in the conventional connector housing.
Figure 3A:
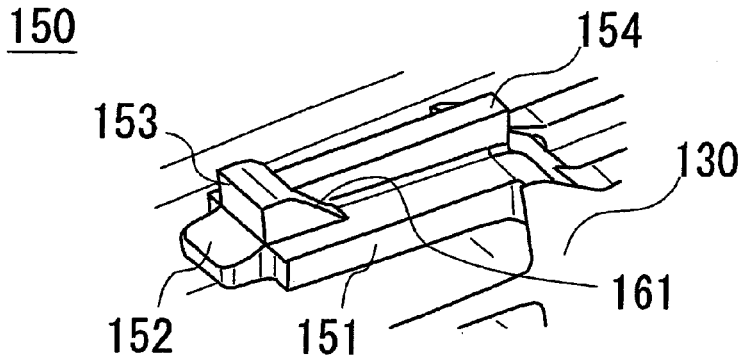
FIGS. 3A to 3D are views showing a lance formed within the conventional connector housing.
Figure 3B:
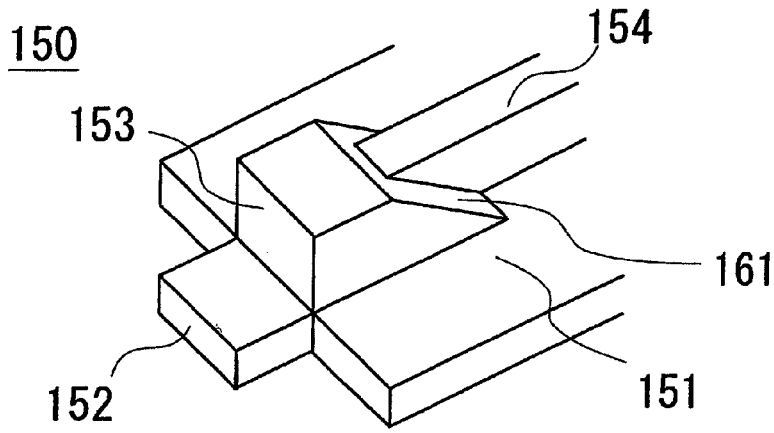
Figure 3C:
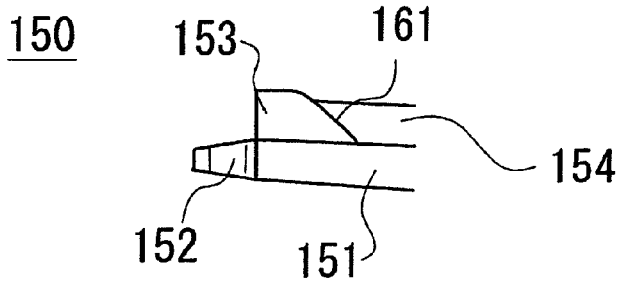
Figure 3D:
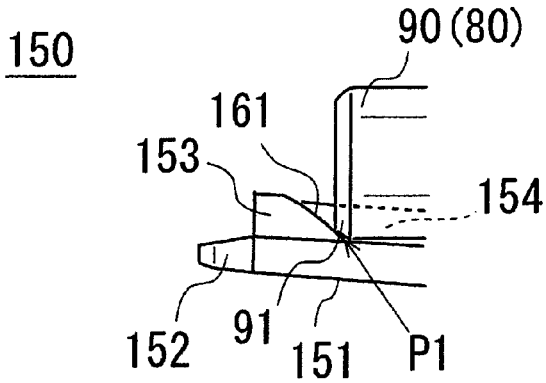
Figure 4:
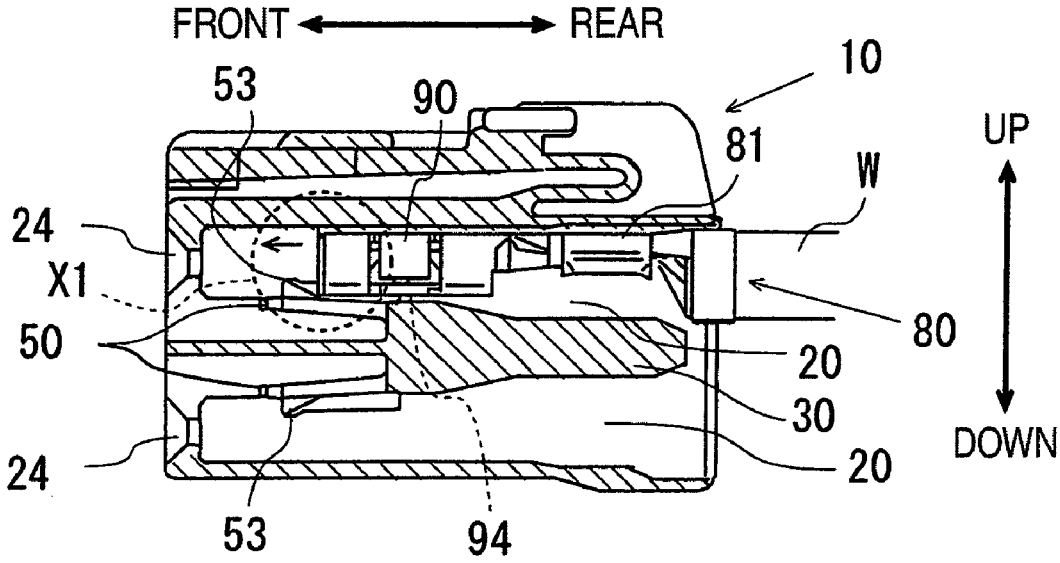
FIG. 4 is a cross-sectional view of a preferred embodiment of a connector housing of the present invention.

FIG. 4 is a cross-sectional view of the connector housing 10 of the present invention, showing a condition in which the metal terminal 80 is inserted in the connector housing 10, and a front end 91 of the metal terminal 80 abuts against the lance beak 53 of the lance 50. This connector housing 10 differs from the connector housing 110 of FIG. 1 only in its lance 50, and therefore identical portions will be designated by identical reference numerals, respectively, and mainly the lance 50 will be described. Also, the process of inserting the metal terminal 80 into the housing 10 is the same as that shown in FIGS. 1A to 1C except that the lance 50 has the difference construction, and therefore FIG. 4 corresponding to FIG. 1B is shown here as a representative view. As described above for FIG. 1, the housing 10 includes upper and lower receiving chambers 20, male terminal insertion holes 24 formed respectively at the front sides of the two receiving chambers 20, and the lances 50 formed on and extending forwardly from a generally central portion of a receiving chamber partition portion 30 separating the pair of upper and lower receiving chambers 20 from each other.

Figure 5A:
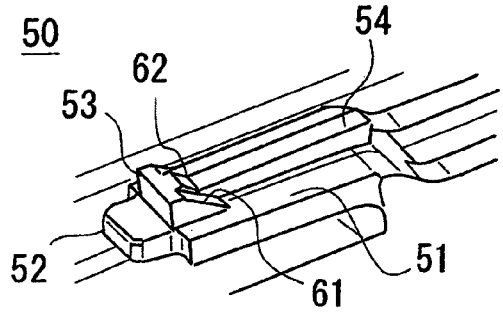
FIGS. 5A to 5E are views showing a lance formed within the connector housing.
Figure 5B:
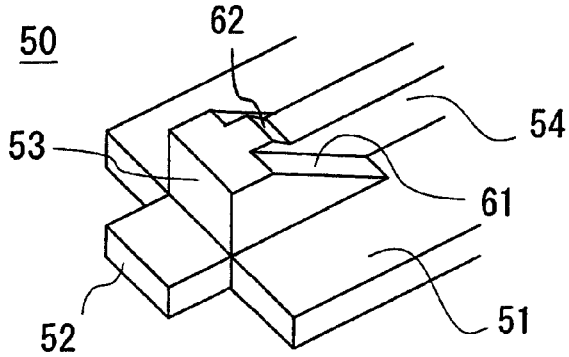
Figure 5C:
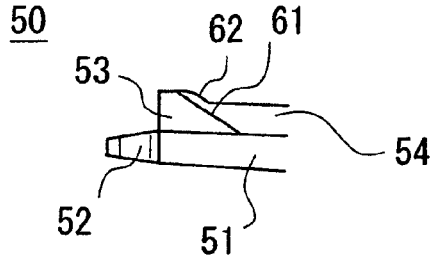
Figure 5D:
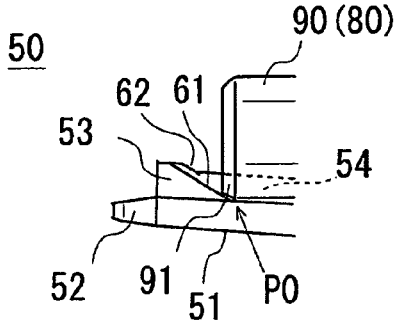
Figure 5E:
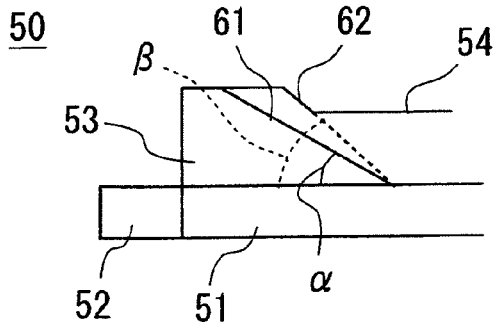

FIGS. 5A to 5E show the lance 50. FIG. 5A is a perspective view showing the lance 50, FIG. 5B is a perspective view schematically showing the lance beak 53 of the lance 50, FIG. 5C is a side-elevational view showing the lance beak 53 of the lance 50, FIG. 5D is a side-elevational view (an enlarged view of a region X1 of FIG. 4), showing a condition in which the front end 91 of the metal terminal 80 abuts against the lance beak 53, and FIG. 5E is a side-elevational view schematically showing the lance beak 53 of the lance 50.

As best shown in FIGS. 5A and 4, two lance bases 51 having a generally rectangular shape and a predetermined length are formed on and extend forwardly (left in the drawings) from the receiving chamber partition portion 30 as described above for FIG. 1A. The lance beak 53 is formed on a front end portion of each lance base 51, and is disposed centrally of the width of the lance base 51. The lance 50 has a front free end 52 formed at the front side of the lance beak 53, and extends forwardly from the lance base 51. A lance guide 54 is formed on a widthwise-central portion of the lance 51, and extends in the forward-rearward direction, that is, extends from a proximal end portion of the lance base 51 to the lance beak 53.

A rear slanting surface of the lance beak 53 is formed by two kinds of slanting surfaces, and more specifically includes a pair of beak side slanting surfaces 61 (each having a first inclination angle $\alpha$) formed respectively at widthwise-opposite side portions thereof, and a beak central slanting surface 62 (having a second inclination angle $\beta$) formed at a widthwise-central portion thereof and interposed between the pair of beak side slanting surfaces 61. The first inclination angle $\alpha$ is smaller than the second inclination angle $\beta$, and in other words the two beak side slanting surfaces 61 are gentler in inclination than the beak central slanting surface 62. The width of the beak central slanting surface 62 is equal to the width of the lance guide 54. Namely, the upper surface of the lance guide 54 is continuous with the beak central slanting surface 62. At an arbitrary point in the direction of extending of the lance 50, each beak side slanting surface 61 is disposed lower than the beak central slanting surface 62, the upper surface of the lance guide 54 or the upper surface of the lance beak 53. Namely, the widthwise-opposite side portions of the lance beak 53 are one step lower over the predetermined length from the rear side toward the front side.

As described above, the beak side slanting surfaces 61 (which define the portions (indicated by a point P0 in FIG. 5D) of the lance beak 53 with which the front end 91 of a connection portion body 90 of the metal terminal 80 is brought into abutting engagement when inserting the metal terminal 80 into the receiving chamber 20) can be made gentle in inclination angle, and therefore the insertion of the metal terminal 80 into the receiving chamber 20 can be effected smoothly, so that the efficiency of the operation can be enhanced. And besides, the shaving of the lance 50 due to the striking abutment of the metal terminal 80, incomplete electrical connection due to resulting shavings, etc., can be prevented.

Furthermore, the beak central slanting surface 62 formed on the widthwise-central portion of the lance beak 53 is equal in width to the lance guide 54 extending from the rear side of the lance 50, and with this construction there can be achieved an effect as obtained when the lance guide 54 is extended to the front end portion of the lance 50. Therefore, the shaking of the metal terminal 80 is prevented. Furthermore, the inclination of the beak central slanting surface 62 can be determined independently of the beak side slanting surfaces 61, and therefore the retaining engagement of the lance beak 53 with the beak retaining hole 94 of the metal terminal 80 can be properly maintained. More specifically, the metal terminal 80 can be prevented from being inserted excessively forwardly.

The present invention has been described on the basis of the above embodiment. This embodiment is merely an exemplary example, and the constructions and shapes of the various portions of the embodiment can be suitably modified, and it will be obvious to those skilled in the art that such modifications fall within the scope of the invention.

Figure 6:
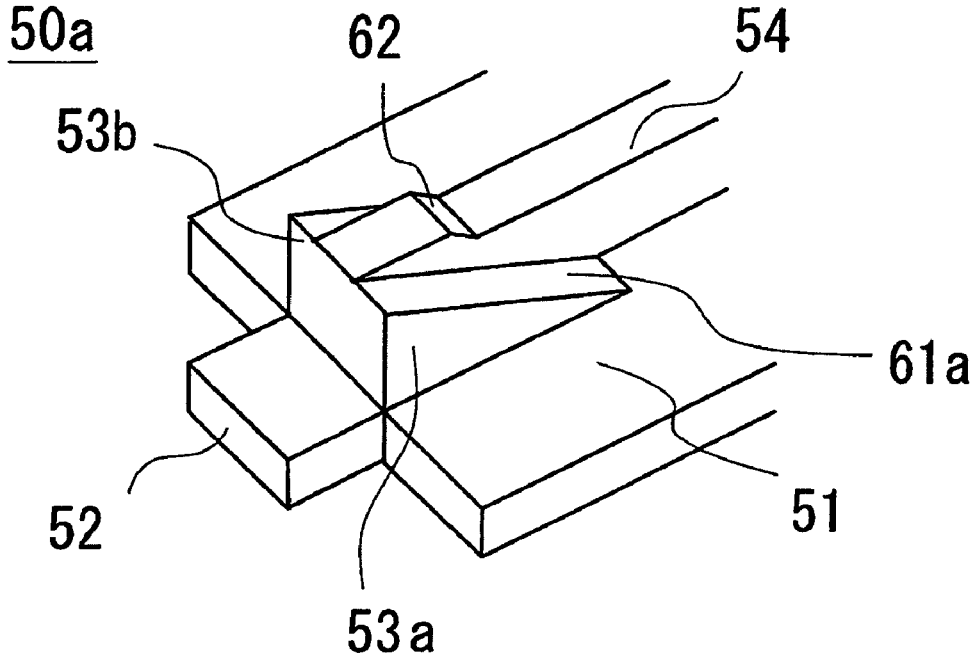
FIG. 6 is a view showing a modified lance formed within the connector housing.

FIG. 6 shows a modified form of the invention. In a lance 50*a* of FIG. 6, a pair of beak side slanting surfaces 61*a* extend from a front end 53*b* of a lance beak 53*a* to a rear end thereof. Namely, a lance guide 54 is extended to the front end 53*b* of the lance beak 53*a*. In this construction, the lance guide 54 continues to act with a guide groove 95 until just before the lance beak 53*a* is fitted into the beak retaining hole 94 of the metal terminal 80. As a result, the occurrence of the above-mentioned striking abutment can be reduced, and also the metal terminal 80 can be smoothly moved until it is completely inserted.

In the above embodiment, the point of intersection of an extension line of the beak central slanting surface 62 with the lance base 51 coincides with the point of intersection of each beak side slanting surface 61 with the lance base 51. However, the invention is not limited to this construction, and the two intersection points may be offset from each other in the forward-rearward direction in so far as the inclination angle $\alpha$ of the beak side slanting surface 61 is smaller than the inclination angle $\beta$ of the beak central slanting surface 62. Furthermore, the beak side slanting surface 61, as well as the beak central slanting surface 62, does not always need to have the single inclination angle $\alpha$, $\beta$, but may comprise a plurality of surfaces of different inclination angles or a curved surface.

What is claimed is:

1. A connector housing, comprising:

a receiving chamber; and a retaining arm formed within the receiving chamber for fixing a metal terminal to be inserted into the receiving chamber, the retaining arm extends in a direction of insertion of the metal terminal, and the retaining arm has a convex retaining portion to be engaged with a predetermined retaining hole formed in the metal terminal;

wherein the retaining portion has a first slanting surface formed at a central portion of the retaining portion in a direction perpendicular to the direction of insertion of the metal terminal, and a pair of second slanting surfaces formed respectively at opposite side portions to the central portion, the second slanting surfaces being gentler in inclination angle than the first slanting surface; and at an arbitrary position in the direction of extending of the retaining arm in a range in which the first slanting surface is disposed above a predetermined height, the second slanting surfaces are disposed lower than the first slanting surface.

2. The connector housing according to claim 1, wherein the retaining arm has a guide portion continuously extending rearward from the first slanting surface of the retaining portion, and the guide portion serves to guide the insertion of the metal terminal.

3. The connector housing according to claim 2, wherein the guide portion is equal in width to the first slanting surface.

4. A connector, comprising:

a connector housing as defined in claim 1; and a metal terminal fixed by the retaining arm of the connector housing.

5. The connector housing according to claim 1, wherein the second slanting surfaces are gentler in inclination angle than the first slanting surface relative to the direction of insertion of the metal terminal.

6. The connector housing according to claim 1, wherein a smallest angle between the second slanting surfaces and the direction of insertion of the metal terminal is smaller than a smallest angle between the first slanting surface and the direction of insertion of the metal terminal when the retaining arm is in a non-deflected position.

* * * * *